US009386637B2

(12) United States Patent
Edwards

(10) Patent No.: US 9,386,637 B2
(45) Date of Patent: Jul. 5, 2016

(54) DEVICE AND METHOD FOR TIME MULTIPLEXING SWITCHABLE OPTICAL ELEMENTS FOR CONTROLLABLE LIGHTING

(71) Applicant: KONINKLIJKE PHILIPS N.V., Eindhoven (NL)

(72) Inventor: Martin John Edwards, Solihull (GB)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/394,860

(22) PCT Filed: Apr. 16, 2013

(86) PCT No.: PCT/IB2013/053009
§ 371 (c)(1),
(2) Date: Oct. 16, 2014

(87) PCT Pub. No.: WO2013/156927
PCT Pub. Date: Oct. 24, 2013

(65) Prior Publication Data

US 2015/0097496 A1 Apr. 9, 2015

Related U.S. Application Data

(60) Provisional application No. 61/635,940, filed on Apr. 20, 2012.

(51) Int. Cl.
*H05B 33/08* (2006.01)
*F21V 7/00* (2006.01)
(Continued)

(52) U.S. Cl.
CPC ..... *H05B 33/08* (2013.01); *F21S 10/02* (2013.01); *F21V 3/0427* (2013.01);
(Continued)

(58) Field of Classification Search
CPC ..... H05B 37/02; F21V 7/02; F21V 3/0427
See application file for complete search history.

(56) References Cited

U.S. PATENT DOCUMENTS

2006/0221444 A1* 10/2006 Fukaishi ..... G02B 27/2214 359/472
2008/0273005 A1 11/2008 Chen
(Continued)

FOREIGN PATENT DOCUMENTS

EP 2216592 A2 8/2010

OTHER PUBLICATIONS

Shahram Izadi et al, "Going Beyond th Display: A Surface Technology with an Electronically Switchable Diffuser", Microsoft Research Cambridge, CB3 0FB, UK, pp. 269-278.
(Continued)

*Primary Examiner* — Douglas W Owens
*Assistant Examiner* — Pedro C Fernandez

(57) ABSTRACT

Methods and apparatus f or electrically controlling a luminaire to alter it s appearance and illumination effects are disclosed. A luminaire (100) having a multiplexing controller controlling one or more LED light sources (110) and one or more electrically switchable optical elements (150). The light sources are switched between at least two illumination states and the optical elements are switched between at least two optical states during an illumination period. The switching sequence is fast enough not to be detected by an observer. As a result the lighting module or luminaire is perceived to have a substantially continuous light output. The multiplexing controller rapidly time sequences the states of light sources and switchable surfaces to produce visual changes to the luminaire and/or objects illuminated by the luminaire.

18 Claims, 16 Drawing Sheets

(51) Int. Cl.

| | |
|---|---|
| ***F21V 3/04*** | (2006.01) |
| ***F21V 14/00*** | (2006.01) |
| ***F21S 10/02*** | (2006.01) |
| ***H05B 37/02*** | (2006.01) |

(52) U.S. Cl.
CPC ..... *F21V 7/0008* (2013.01); *F21V 14/003* (2013.01); *H05B 33/0803* (2013.01); *H05B 33/0857* (2013.01); *H05B 37/02* (2013.01)

(56) References Cited

U.S. PATENT DOCUMENTS

2010/0226128 A1* 9/2010 Van Beeck ..... F21V 5/008 362/235
2010/0265707 A1* 10/2010 Van Herpen ..... F21V 14/003 362/235
2011/0176091 A1 7/2011 Boonekamp
2011/0188106 A1* 8/2011 Bae ..... G02B 26/08 359/226.3
2012/0163021 A1* 6/2012 Bohn ..... G02F 1/133615 362/608
2012/0265707 A1 10/2012 Bushnell

OTHER PUBLICATIONS

Ronald Sidharta et al, "The Development of Multi-Depth Pepper's Ghost Display for Mixed Reality System", Proceedings of the 16th International Conference on Artifical Reality and Telexistence-Workshops (ICAT-06), IEEE Computer Society.

* cited by examiner

Front View

DEVICE AND METHOD FOR TIME MULTIPLEXING SWITCHABLE OPTICAL ELEMENTS FOR CONTROLLABLE LIGHTING

CROSS-REFERENCE TO PRIOR APPLICATIONS

This application is the U.S. National Phase application under 35 U.S.C. § of International Application No. PCT/IB2013/053009, filed on Apr. 16, 2013, which claims the benefit of U.S. Provisional Patent Application No. 61/635,940, filed on Apr. 20, 2012. These applications are hereby incorporated by reference herein.

The present invention is directed generally to lighting technologies. More particularly, various inventive methods and apparatus disclosed herein relate to controlling switchable optical elements and light sources.

Digital lighting technologies, i.e. illumination based on semiconductor light sources, such as light-emitting diodes (LEDs), offer a viable alternative to traditional fluorescent, HID, and incandescent lighting modules. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications. Some of the fixtures embodying these sources feature a lighting module, including one or more LEDs capable of producing different colors, e.g. red, green, and blue, as well as a processor for independently controlling the output of the LEDs in order to generate a variety of colors and color-changing lighting effects.

Electrically switchable scattering films have been used in the past to make volumetric displays. In such applications, stacks of switchable scattering films are used as switchable screens onto which two-dimensional (2D) images can be projected. By having multiple screens and selecting that one of the screens is in a diffuse state and the others are in a clear state, images can be positioned at different depths within a three-dimensional (3D) space creating a volumetric display. The screens are switched between a clear and a diffuse or scattering state at a frequency which is high enough to prevent the perception of flickering.

Electrically switchable scattering films have also been used to create a rear projection interactive surface technology. With this technology images are projected onto and through a switchable screen which forms an interactive surface. The screen is rapidly switched between a diffuse state and a clear state. When the screen is in the diffuse state images to be shown on the screen are projected while when in the clear state images can be projected through the screen onto secondary surfaces or objects, for example paper held above the screen. In one example, an object containing a prism and a diffuse surface can be placed above the screen and text can then be projected through the screen and via the prism to be displayed on the sides of the object.

Electrically adjustable optical elements include, for example, a passive beam-shaping element and a controllable scattering element. Alternatively, an electrically switchable cell may be used to control the direction of the light. In these examples, changes to the state of the electrically switchable optical elements are made relatively infrequently. This limits the extent to which the illumination effect created by the lighting module or luminaire can be controlled, the illumination effect being directly related to the state of the optical elements.

Lighting module shades and luminaires typically have a fixed visual appearance to the extent that their size and shape cannot normally be changed although in some designs mechanical adjustment of the components of the luminaire may be possible as away of adjusting the illumination pattern. It is sometimes desired to change the appearance of a luminaire depending on the environment in which it is used, the purpose for which it is being used and according to the preferences of the user. This makes the luminaire more versatile and means that it can be applied in a wider range of situations.

Making physical changes to a luminaire in order to change its visual appearance, for example moving or replacing components, is inconvenient. The luminaire may be difficult to access, for example it may be positioned on a wall or a ceiling.

Thus, there is a need in the art to address some the shortcomings of the conventional approaches described above.

The present disclosure is generally directed to inventive methods and apparatus for electrically controlling a luminaire to alter its appearance and illumination effects. For example, a multiplexing controller may rapidly time sequence electrically controlled states of light sources and switchable surfaces to produce color outlined shadows of illuminated objects, or a luminaire appearing as a first color yet producing light of a second color, or a luminaire that may be electronically controlled to change its appearance.

A luminaire or a lighting module employing, for example, one or more LED light sources and one or more electrically switchable optical elements, where the light sources are switched between at least two sets of brightness states and the optical elements are switched between at least two optical states during an illumination period. The switching sequence is repeated at a frequency which is equal to one divided by the illumination period, this frequency being higher than the frequency at which changes to the light output of the lighting module or luminaire are detected by the human visual system. As a result the lighting module or luminaire is perceived to have a substantially continuous light output.

By dividing the illumination period into a number of sub-periods and appropriately controlling the brightness of the LEDs and the optical state of the optical elements during each sub-period, it is possible to greatly increase the degree of control over the illumination effect produced by the lighting module, luminaire or lighting system.

An exemplary lighting module or luminaire may generate two or more substantially independently controllable lighting effects. For example, a lighting module may provide a direct lighting effect and a diffuse lighting effect with the intensity of the direct and diffuse illumination being independently controllable. The ability to independently control the lighting effects arises because these effects can be generated in a time sequential manner during different illumination sub-periods. This means that the number of components required to form the lighting module or luminaire can be reduced compared to the case where the different lighting effects are produced simultaneously by separate elements.

In exemplary embodiments, the visual appearance of luminaire and the lighting effects produced by the luminaire are substantially independently controllable. This enables interesting visual effects to be created and allows users to customize the appearance of the luminaire without greatly changing the illumination effect which is provided.

Further examples disclosed herein include a luminaire with multiple surfaces with elements which can be electrically controlled to substantially change their appearance. For example the surfaces may have a first state in which they are substantially optically transparent and a second state in which they are optically diffusing. When the luminaire is viewed, those elements in the first state have a low visibility, while those elements in the second states become visible and, along with other components of the luminaire which are not transparent, largely determine the appearance of the luminaire.

By changing the state of the controlled elements the appearance of the luminaire and the illumination effect created by the luminaire can be modified. For example, the luminaire can be made to appear larger or smaller or the shape of its surface can appear to change by selectively controlling the elements.

Generally, in one aspect, an apparatus producing light discernible to a viewer includes alighting module with a first illumination element producing a first color light, and a second illumination element producing a second color light, wherein the first color light is visually distinct from the second color light. The apparatus further includes a switchable surface electrically switchable between a first optical state and a second optical state disposed substantially between the viewer and the lighting module, a multiplexing controller in electrical communication with the lighting module and the switchable surface, configured to independently control a first illumination element state, a second illumination element state, and a switchable surface state. The multiplexing controller is operable to switch each of the first illumination element state, the second illumination element state, and the switchable surface state at a rate of up to at least 10 Hz.

In one embodiment, the first optical state includes a substantially transparent state, and the second optical state has a substantially light scattering state. In one version, the first illumination element includes a first LED and the second illumination element includes a second LED.

In another embodiment, the multiplexing controller is configured to switch the first illumination element on and the second illumination element off while the switchable surface is in the second optical state, and to switch the second illumination element on while the switchable surface is in the first optical state. In one version, the multiplexing controller is configured to switch the first illumination element and second illumination element on for a substantially similar first duration while the switchable surface is in the first optical state, and to switch the first illumination element on for a second duration and to switch the second illumination element on for a third duration while the switchable surface is in the second optical state, wherein the second duration is longer than the third duration.

In another embodiment, the switchable surface further includes a first region electrically switchable between the first optical state and the second optical state, and a second region electrically switchable between the first optical state and the second optical state, and wherein the first region and the second region are independently controlled by the multiplexing controller.

Generally, in another aspect, an apparatus producing light discernible to a viewer includes a lighting module having a first illumination element producing a first color light, a second illumination element producing a second color light, and a third illumination element producing a third color light, wherein the first color light, the second color light, and the third color light are visually distinct from one another. A second switchable surface electrically switchable between a first optical state and a second optical state is disposed substantially between the viewer and the lighting module. A first switchable surface electrically switchable between a first optical state and a second optical state disposed substantially between the second switchable surface and the lighting module. A multiplexing controller in electrical communication with the lighting module, the first switchable surface, and the second switchable surface, configured to independently control a first illumination element state, a second illumination element state, a third illumination element state, a first switchable surface state, and a second switchable surface state. The multiplexing controller is configured to independently switch each of the first illumination element state, the second illumination element state, the third illumination element state, the first switchable surface state, and the second switchable surface state at a rate of up to at least 10 Hz.

In one embodiment, the first optical state is a substantially transparent state, and the second optical state is a substantially light scattering state. The first illumination element may include a first LED, the second illumination element may include a second LED, and the third illumination may include a third LED. In aversion of the embodiment, the multiplexing controller is configured to switch the first switchable surface to scatter the first color light, and to switch the second switchable surface to scatter the second color light. The first switchable surface may substantially enclose the lighting module, and the second switchable surface may substantially enclose the first switchable surface.

In yet another aspect, the invention relates to a luminaire for producing light discernible to a viewer that includes a lighting module, an enclosure at least partially surrounding the lighting module having a first switchable surface electrically switchable between a first optical state and a second optical state, and a second switchable surface electrically switchable between a first optical state and a second optical state. A controller is in electrical communication with the lighting module, the first switchable surface, and the second switchable surface. The controller is configured to independently control a lighting module illumination element state, a first switchable surface state, and a second switchable surface state. The first optical state may include a substantially transparent state, and the second optical state may include a substantially light scattering state.

In one embodiment under this aspect, the first switchable surface substantially encloses the lighting module, and the second switchable surface substantially encloses the first switchable surface.

Generally, in still another aspect, the invention relates to a method for controlling a luminaire having a controller, a first light source, a second light source, and a switchable surface. The method includes the steps of periodically switching the switchable surface from a first optical state to a second optical state, wherein the switching has a period of at most 1 ms, independently controlling the first light source to switch during the first optical state and/or the second optical state, and independently controlling the second light source to switch during the first optical state and/or the second optical state. The first optical state may include a substantially transparent state; and the second optical state may include a substantially light scattering state.

In one embodiment of this aspect, during a first time period, a step includes switching the switchable surface to the scattering state, switching the first light source to the on state, and switching the second light source to the off state. During a second time period, the step includes switching the switchable surface to the substantially transparent state, switching the first light source to the off state, and switching the second light source to the on state, cyclically repeating the first and second time periods. In one version of the above embodiment, a step includes, during the first time period, projecting an image upon the switchable surface.

In yet another aspect, the invention relates to a method for controlling a luminaire having a controller configured to control a first light source, a second light source, a third light source, a first switchable surface, a second switchable surf ace, the method includes the steps of switching the first switchable surface between a first optical state and a second optical state, switching the second switchable surface between the first optical state and the second optical state, switching the first light between an on state and an off state, switching the second light source between the on state and the off state, and switching the third light source between the on state and the off state.

In an embodiment of this aspect, the first optical state is a substantially transparent state, and the second optical state is a substantially light scattering state. In a second embodiment, during a first time period, a step includes switching the first switchable surface to the scattering state, switching the second switchable surface to the substantially transparent state, switching the first light source and the second light source to the off state, and switching the third light source to the on state. During a second time period, the step further includes switching the second switchable surface to the scattering state, switching the first switchable surface to the substantially transparent state, switching the third light source and the second light source to the off state, and switching the first light source to the on state. During a third time period, the step includes switching the first switchable surface and the second switchable surface to the substantially transparent state, switching the third light source and the first light source to the off state, and switching the second light source to the on state, and cydically repeating the first, second and third time periods.

The invention also relates to a system for illuminating an interior space includes a lighting module having a first illumination element producing a first color light, and a second illumination element producing a second color light, wherein the first color light is visually distinct from the second color light. The system includes a switchable surface electrically switchable between a first optical state and a second optical state disposed substantially apart from and the lighting module, wherein the switchable surface is substantially illuminated by the lighting module, and a multiplexing controller in electrical communication with the lighting module and the switchable surface, configured to independently control a first illumination element state, a second illumination element state, and a switchable surface state. The multiplexing controller is operable to switch each of the first illumination element state, the second illumination element state, and the switchable surface state at a rate of up to at least 10 Hz. In an embodiment of the sixth aspect, the first optical state is a substantially transparent state, and the second optical state is a substantially light scattering state. The switchable surface may be a window.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lighting modules, halogen lighting modules), fluorescent sources, phosphorescent sources, high-intensity discharge sources (e.g., sodium vapor, mercury vapor, and metal halide lighting modules), lasers, other types of electroluminescent sources, pyro-luminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from alight source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The term "switchable surface" generally refers to an electro-optical element with a surface with controllable optical properties. The controllable properties include, but are not limited to, transparency, transmission, reflection, and diffusion. In particular, there are electro-optical elements which can be switched between reflecting (mirror like) and transparent states as well as, for example, PDLC, which can be switched between scattering and clear states. There are also materials which can have their transmission (absorption) controlled and materials which change the characteristics of the light reflected from them (like electronic paper display materials). Such materials may be controlled to appear to switch directly from one optical state to another, for example, from clear to scattering, and the materials may have intermediate states. The characteristics of electrical signals used to control these switchable surfaces are known to persons having ordinary skill in the art, and is therefore omitted from this disclosure.

The terms "lighting fixture" and "luminaire" are used interchangeably herein to refer to an implementation or arrangement of one or more lighting units in a particular form factor, assembly, or package. The terms "lighting unit" and "lighting module" are used interchangeably herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting module" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASIOs), and field-programmable gate arrays (FPGAs).

In various implementations, a processor or controller may be associated with one or more storage media (generically referred to herein as "memory," e.g., volatile and non-volatile computer memory such as PAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

In the drawings, like reference characters generally refer to the same parts throughout the different views. Also, the drawings are not necessarily to scale, emphasis instead generally being placed upon illustrating the principles of the invention.

Figure 1:
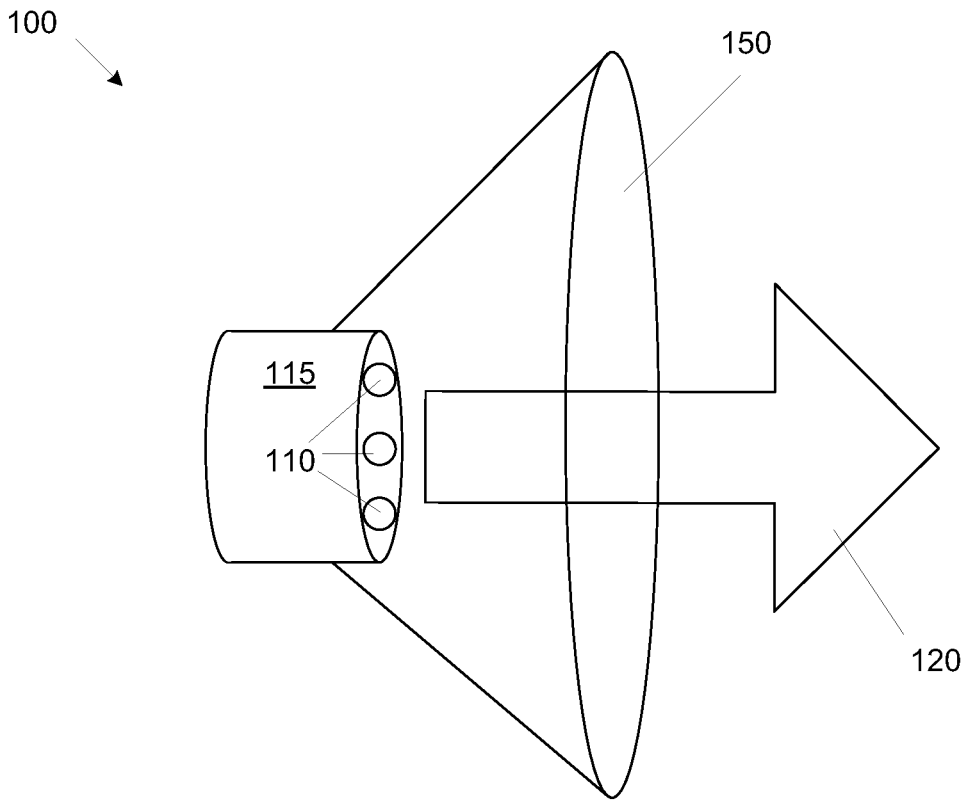
FIG. 1 is a schematic diagram of a first embodiment of a controlled luminaire.
Figure 18A:
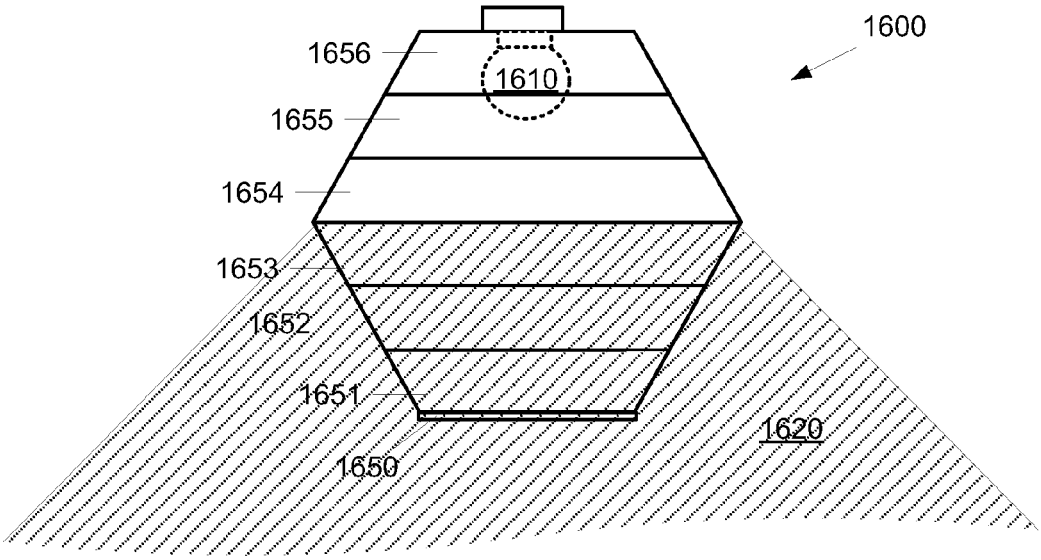

FIGS. 18A and 1BB are schematic diagrams illustrating two additional illumination patterns of the seventh embodiment of the controlled luminaire.

Figure 19A:
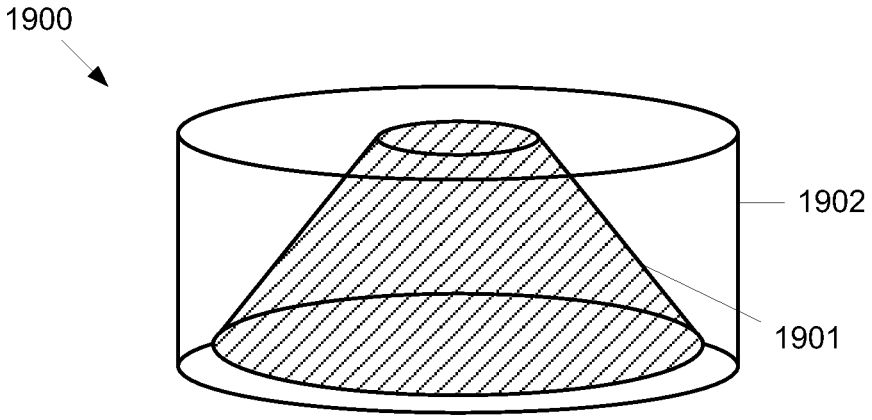
Figure 19B:
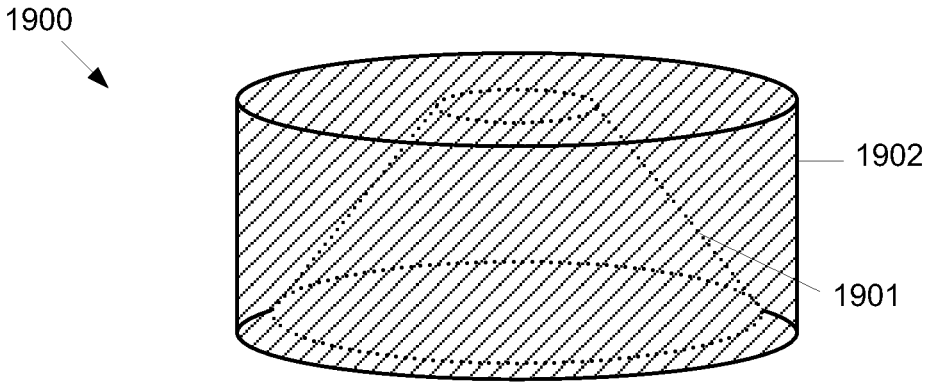

FIGS. 19A and 19B illustrate an embodiment of a luminaire with nested switchable surfaces.

Traditionally, different types of luminaires have been employed to produce different lighting effects. Some interior spaces may be fitted with multiple luminaires to provide different types of lighting, for example, direct, undiffused light, direct diffused light, indirect undiffused light, and indirect diffused light. It is advantageous to provide a luminaires that may be controlled to switchably provide two or more of these lighting types, as well as additional lighting effects. More generally, Applicants have recognized and appreciated that it may be beneficial to coordinate and control rapid switching of lighting elements to produce these and other visual effects.

In view of the foregoing, various embodiments and implementations of the present invention are directed to devices and methods for luminaires with controllable lighting elements and switchable surfaces.

First Embodiment: Control of the Shadows Generated by a Lighting Module or Luminaire A first exemplary embodiment of a controllable lighting module 100 is illustrated schematically in FIG. 1. The lighting module includes a group of at least two LEDs 110 mounted in a housing 115, and an electrically switchable scattering element 150, such as a polymer dispersed liquid crystal (PDLC) sheet. The LEDs 110 are arranged to generate light beam 120 at the output of the lighting module 100, wherein the scattering element 150 is arranged to be in the path of the light beam 120. In this example it is assumed that the LED arrangement includes separate devices which generate, for example, red, green and blue light, the color components being combined to form a white light beam 120. Of course, having two, three, four, or more different colored LEDs in the lighting module 100 including, for example, amber, white, and other colors, is also contemplated.

Figure 2A:
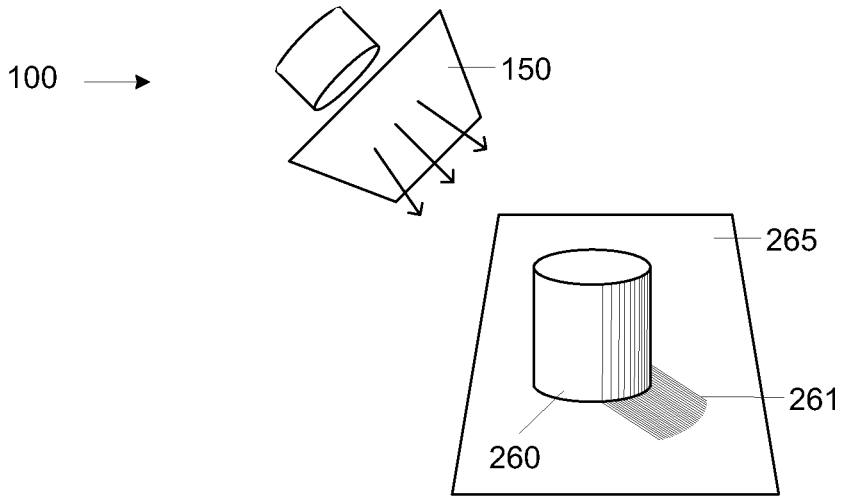
FIGS. 2A and 2B illustrate first and second shadow patterns cast by an object illuminated by the luminaire of the first embodiment.
Figure 2B:
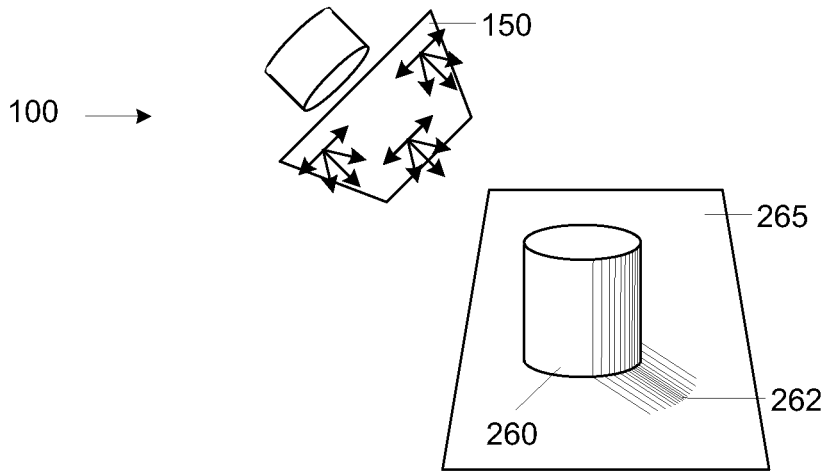

FIGS. 2A and 2B are schematic diagrams of the lighting module 100 illuminating a cylindrical object 260 on a surface 265. The scattering element 150 may be rapidly switched between two scattering states, for example a clear state and a diffuse state, at a frequency which is above the minimum frequency at which flicker is perceived. When the scattering element 150 is in the clear state, as illustrated in FIG. 2A the lighting module 100 produces a first shadow 261 of the object 260 which has sharp and well defined edges as if the light comes from a point source or a collimated source. When the scattering element 150 is in the diffuse state, as shown in FIG. 2B, the lighting module 100 produces a diffuse shadow 262 which has soft or graded edges as if the light comes from a diffuse source. The brightness of the LEDs and hence the brightness and color of the illumination provided by the lighting module can be independently controlled for the two states. The effect seen by someone using the lighting module 100 may be a blend of the sharp shadow 261 (FIG. 2A) and the diffuse shadow 262, wherein the relative weight of the shadows is a function of the time the scattering element 150 is in a transparent state and the amount of time the scattering element 150 is in a scattering state.

Figure 3:
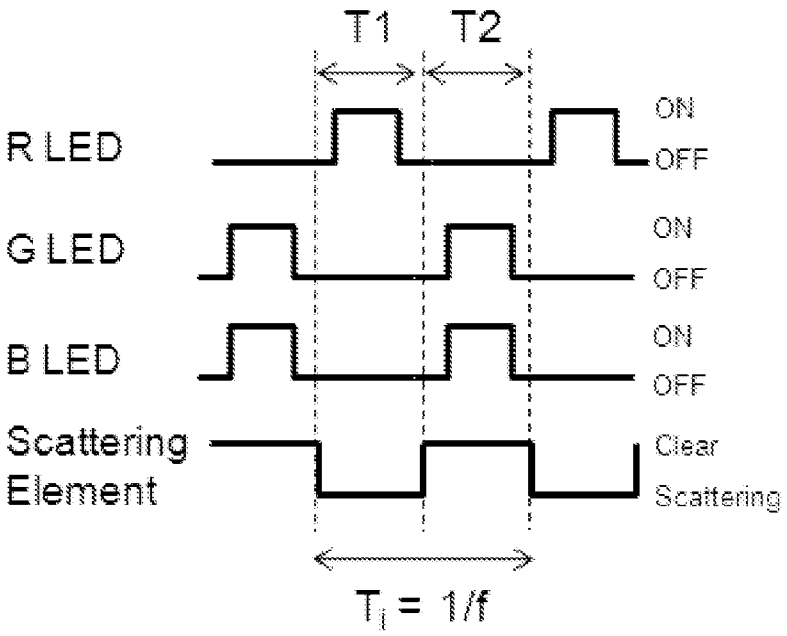
FIG. 3 is a timing diagram of states for lighting and switchable surface elements of the luminaire of the first embodiment.

The waveforms shown in FIG. 3 illustrate a specific example. The repetition period of the waveforms, $T_i$, determines the flicker frequency of the lighting module 100 (FIG. 2B) and this period is arranged to be less than, for example, 20 ms. During the first half of each period, T1 , a drive signal is applied to the scattering element 150 (FIG. 2B) which causes the scattering element 150 (FIG. 2B) to be in a scattering state. During the time period T1 , the LED which generates red light is turned on and the lighting module 100 (FIG. 2B) generates diffuse red illumination. During the second half of each period, T2 , a drive signal is applied to the scattering element 150 (FIG. 2A) which causes the scattering element 150 (FIG. 2A) to be in the clear state. During the time period T2, LEDs generating green and blue light are turned on and the lighting module generates green and blue light with little scattering of the light.

Figure 4:
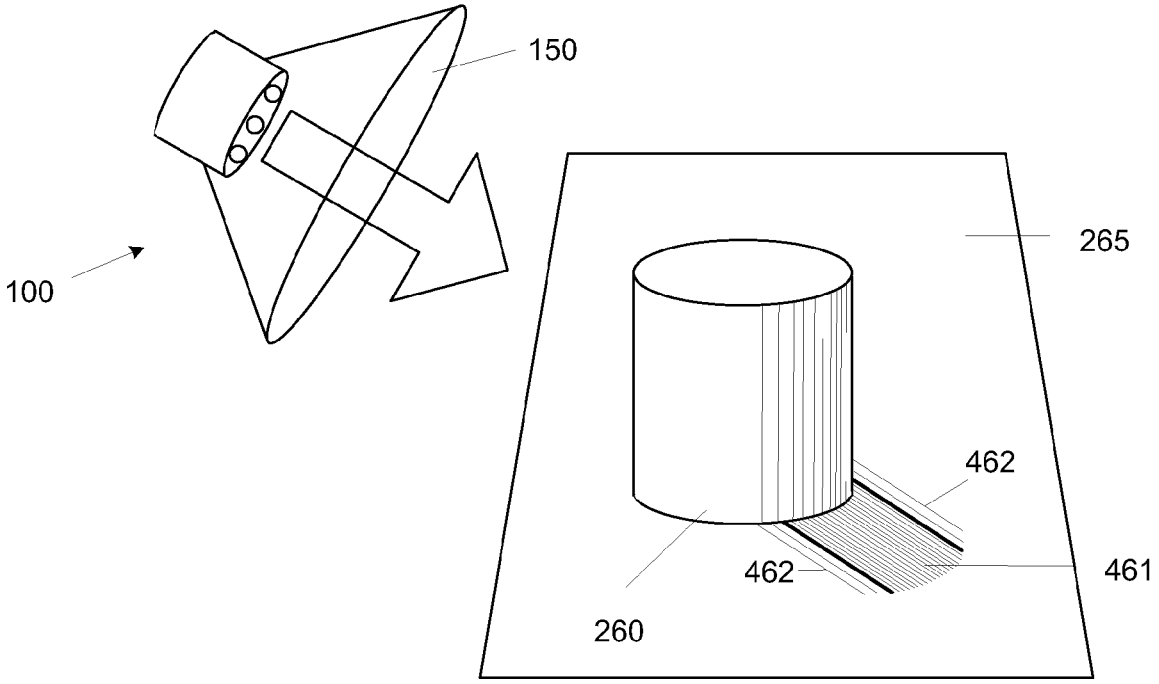
FIG. 4 illustrates a third shadow pattern cast by an object illuminated by the luminaire of the first embodiment.

The perceived illumination effect represents the average of the illumination during T1 and T2 and is illustrated in FIG. 4. The object 260 appears to be illuminated with white light but the shadow 461 created by the object 260 appears to have red and cyan colored edges 462. The type of shadow colors produced depends on the geometry and the resulting overlap of the sharp and soft shadows, for example, all red, all cyan or a combination of red and cyan.

In this example the lighting module 100 is operated with two sub-periods corresponding to diffuse and direct illumination states. However, there it is contemplated to have more than two sub-periods with the scattering element 150 being switched to intermediate scattering states during the additional periods in order to provide a greater control of the illumination effect created by the lighting module 100. Furthermore the LEDs may be provided with intermediate drive currents in order to provide control of the intensity and the color of the different illumination states. Similarly, the relative phases and durations of the red, green and blue LED on pulses may be varied over time, providing a variety of visual effects. For example, the light on the object 260 may remain a constant color, while the color of the edge shadows 462 may change. Furthermore, the change in color of the edge shadows 462 may be gradual, blending from one color to another, or sudden.

Alternatively, under the first embodiment, instead of using at least two LEDs, a single LED may be used where the brightness of the LED may be changed when the scattering element 150 is switched. This produces a visual effect where an illuminated object produces a shadow with a combination of a sharp edge and a soft edge.

Second Embodiment: Control of the Color of a Luminaire and the Color of its Illumination A second exemplary embodiment of a lighting device which makes use of the proposed control method is a luminaire which from its visual appearance would be expected to generate light of a first color but which produces illumination of a second color, different from the first color. Such a luminaire could be used as a desk lighting module having a color, for example, matched to the decoration of a room, while still providing white light illumination on a work surface. Alternatively the luminaire could be mounted on a wall and appear to have a first color but provide illumination of a second color on a floor or ceiling.

Figure 6:
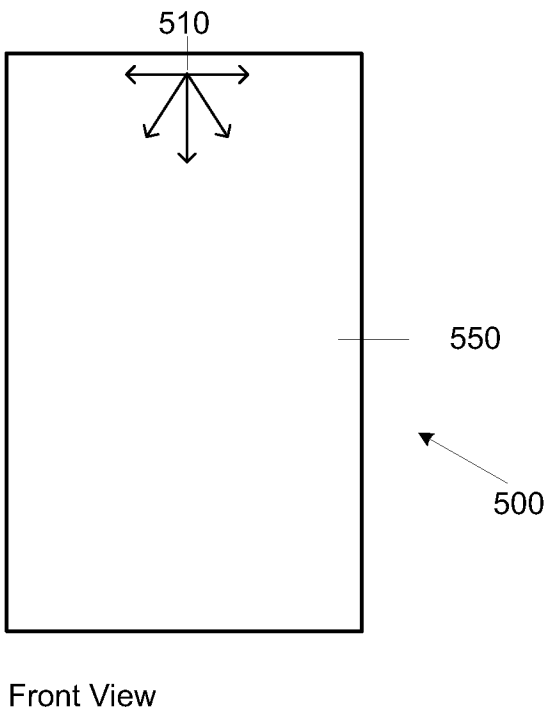
FIG. 6 is a front view schematic drawing of a luminaire under the second embodiment.
Figure 5:
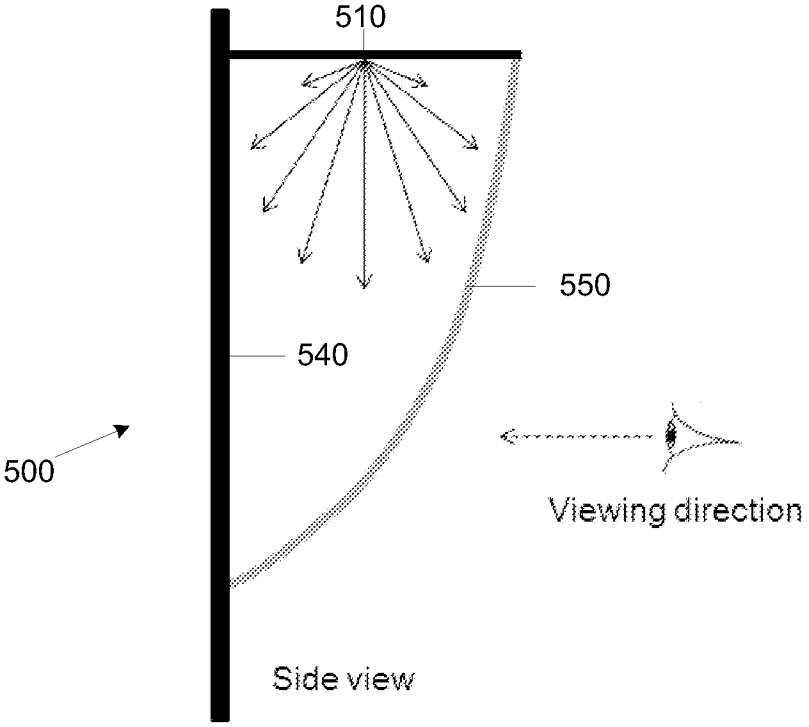
FIG. 5 is a side view schematic drawing of a luminaire under the second embodiment.
Figure 7:
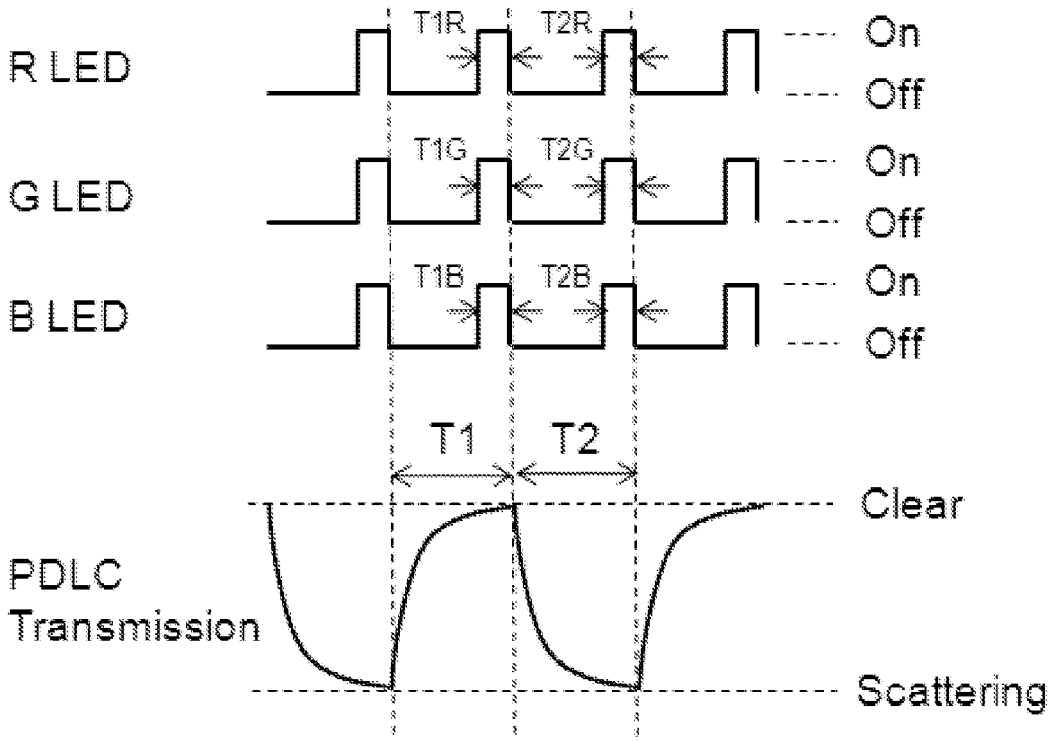
FIG. 7 is a timing diagram of states for lighting and switchable surface elements of the luminaire of the first embodiment.

An example of an arrangement for such a luminaire is shown in FIGS. 5 and 6. The luminaire 500 includes a curved PDLC sheet 550 which forms a visible surface of the luminaire 500 and functions as a switchable optical element. The PDLC sheet 550 is positioned in front of a back panel 540, which is black, and the sheet 550 is illuminated from behind by an arrangement of LEDs 510, containing two or more different colored LEDs, for example, red green and blue LEDs. As in the previous example, the LEDs 510 and scattering element 550 are driven with repetitive signals, as shown by FIG. 7.

During the first half of the drive period, T1, the sheet 550 (FIG. 5) is driven to the clear state and then the LEDs 510 (FIG. 5) are turned on for time periods of T1 R for the red LED, T1 G for the green LED and T1 B for the blue LED. The values of the three time periods determine the effective brightness and color of the light generated by the luminaire 500 (FIG. 5) during the period T1. As the sheet 550 (FIG. 5) is in the clear state during T1 the light generated by the LEDs 510 (FIG. 5) is relatively unaffected by the presence of the sheet 550 (FIG. 5) and falls on objects and surfaces below the luminaire.

During the second half of the drive period, T2, the sheet 550 (FIG. 5) is driven to the scattering state and then the LEDs are turned on for time periods of T2 R for the red LED, T2 G for the green LED and T2 B for the blue LED. The values of this second set of time periods determine the effective brightness and color of the light generated by the luminaire 500 (FIG. 5) during the period T2. As the sheet 550 (FIG. 5) is in the scattering state during T2 , the light generated by the LEDs 510 (FIG. 5) is scattered over a wide range of angles. Much of the light still falls on the objects and surfaces below the sheet 550 (FIG. 5) but this represents a smaller fraction of the light than during T1.

Two of the characteristics of the luminaire 500 (FIG. 5) are its color when viewed directly, that is when an observer looks at the PDLC sheet 550 (FIG. 5), and the color of the illumination that it creates, that is, the color of the light falling on the objects and surfaces below the luminaire 500 (FIG. 5).

When an observer observes the luminaire 500 (FIG. 5) he mainly sees light which is scattered from the PDLC sheet 550 (FIG. 5) during the time period T2 . The color of this light, and therefore the apparent color of the luminaire 500 (FIG. 5), is determined by the time periods T2 R, T2 G and T 2 B. The illumination effect produced by the luminaire 500 (FIG. 5) is the sum of the light falling on the surfaces below the luminaire 500 (FIG. 5) during the time periods T1 and T2 . Therefore the color of the illumination depends on the time periods T1 R, T1 G, T1 B and T2 R, T2 G, T2 B. As mentioned previously, during the time period T2 light is scattered over a wide range of angles and therefore a smaller proportion of the light falls on the surfaces below the luminaire 500 (FIG. 5). The relative proportions of red, green and blue light in the illumination can be expressed as T1 R+kT2 R, T1 G+kT2 G and T1 B+kT2 B, where k is less than 1. The factor k should be taken into account when balancing the proportions of red, green and blue light in the illumination to produce light of a particular color. The value of the factor k depends on the design of the luminaire 500 (FIG. 5). An exemplary range for the value of the factor k for such an arrangement (FIG. 5) may be in the range 0.6 to 0.7. For example, the luminaire 500 (FIG. 5) may be operated so that the sheet 550 (FIG. 5) has a red appearance but the light falling on the surfaces below the luminaire 500 (FIG. 5) is white. In this case T2 G and T2 B may be zero and the relative proportions of red, green and blue light in the light falling on the surfaces may be T1 R+kT2 R, T1 G and T1 B. To give white illumination of the surfaces may require equal contributions of red green and blue light so that T1 R+kT2 R=T1 G=T1 B.

Figure 8:
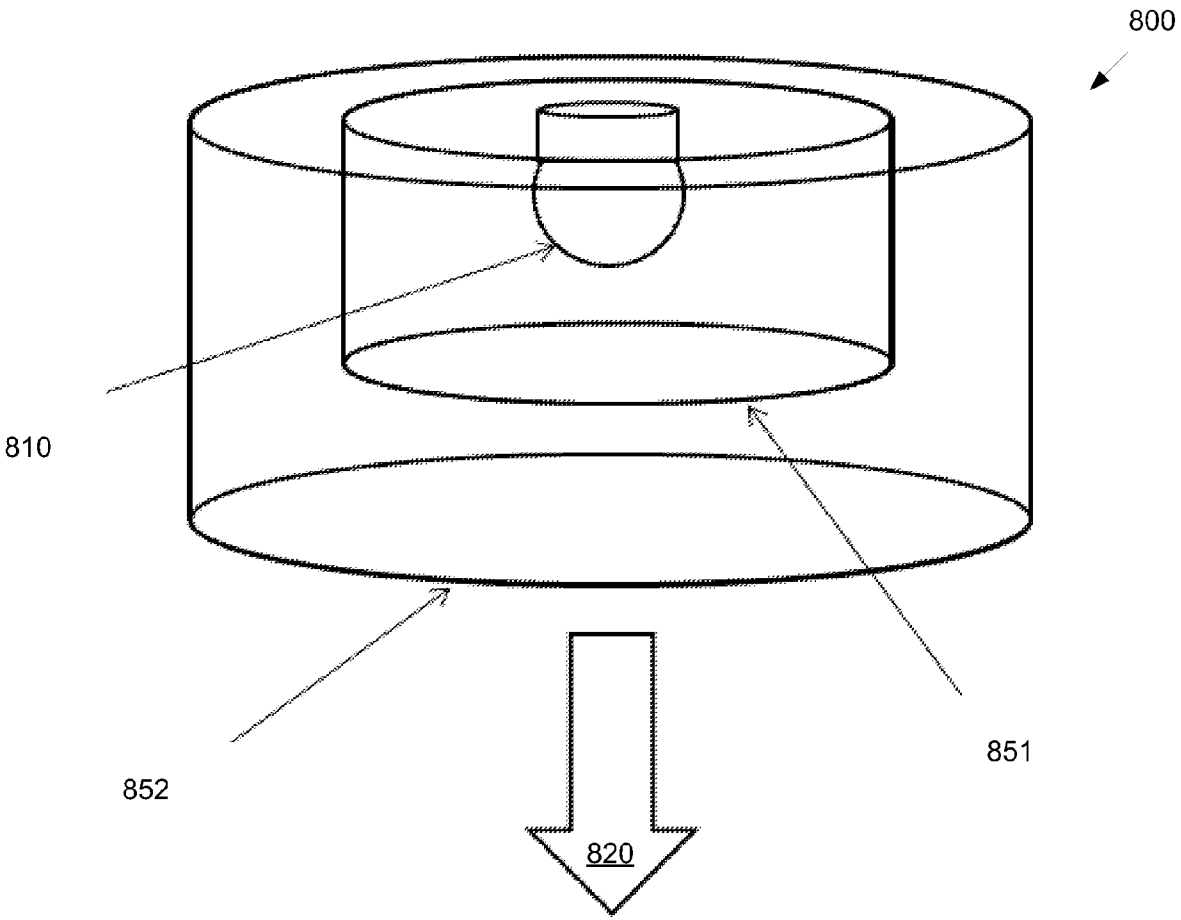
FIG. 8 is a schematic diagram of a luminaire with nested switchable surfaces.
Figure 9:
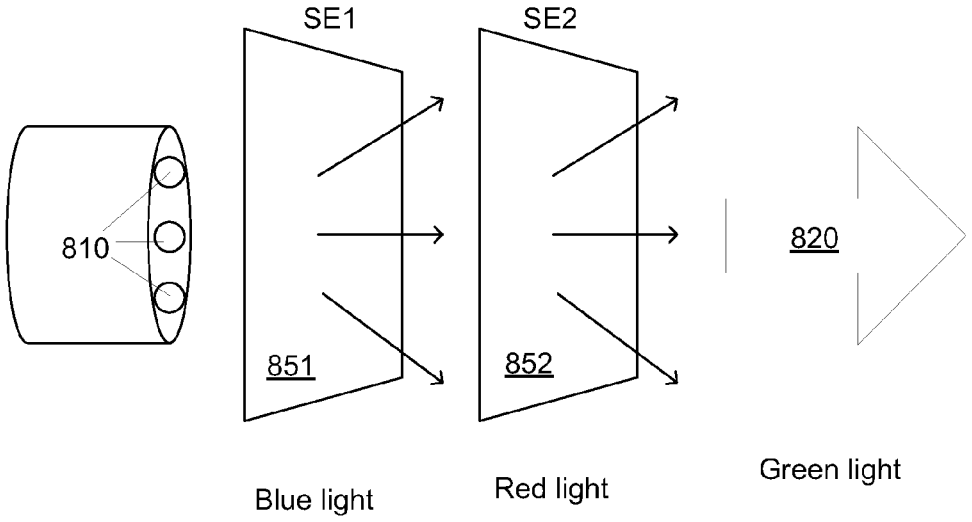
FIG. 9 is a schematic diagram of an exemplary luminaire with two switchable surface elements.
Figure 10:
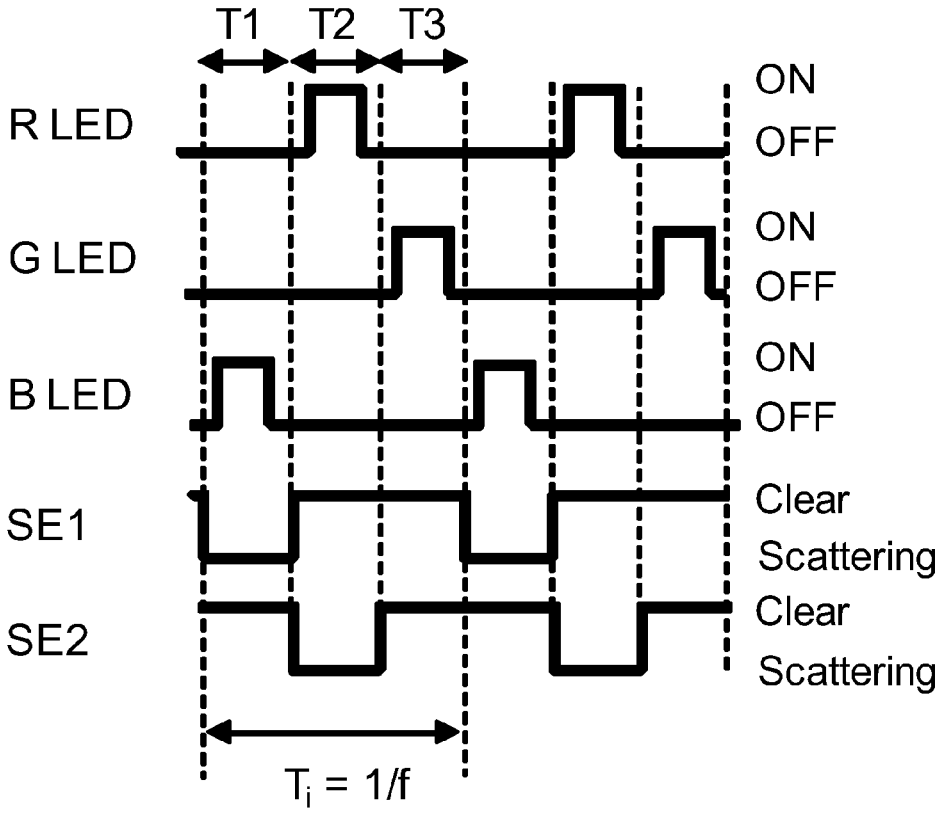
FIG. 10 is a timing diagram of states for lighting and switchable surface elements of the luminaire of the second embodiment.

Third Embodiment: Control the Appearance of a Luminaire with Multiple Switchable Surfaces A third exemplary embodiment of the present invention relates to a luminaire having multiple switchable surfaces. FIG. 8 shows a schematic illustration of a simple luminaire 800. It includes an assembly of LEDs 810 for providing illumination, a first switchable scattering element 851 and a second switchable scattering element 852, in the form of two concentric cylinders of different heights and different diameters. As before, the assembly of LEDs 810 contains at least two different colored LEDs, in this example, red, green and blue LEDs. The visual appearance of the luminaire 800 is determined largely by the shape and the color of light scattered from the scattering elements 851, 852 while its illumination effect is a combination of the direct illumination from an assembly of LEDs 810 and indirect illumination by light which is scattered from the scattering elements 851, 852. FIGS. 9 and 10 illustrate how the scattering elements 851, 852 and the LEDs 110 may be controlled to produce interesting visual effects.

FIG. 9 represents a schematic view of the luminaire 800 and shows parts of the two scattering elements, 851, 852 and red, green and blue LEDs 810 which illuminate both the scattering elements 851, 852 and the environment of the luminaire 800. The timing of the states of the LEDs 810 and the scattering elements 851, 852 is shown by FIG. 10. In this example the illumination period $T_i$ is divided into three sub-periods, T1 to T3. During the first sub-period, T1 , the first scattering element 851 is switched to the scattering state and the second scattering element 852 is switched to the clear or transparent state and the blue LEDs are turned on. The blue light falls on the first scattering element and is scattered over a broad range of angles. The second scattering element 852 does not provide significant further scattering of the light. During the second sub-period, T2 , the first scattering element 851 is switched to the clear state and the second scattering element 852 is switched to the scattering state and the red LEDs are turned on. The red light passes through the first scattering element 851 with little change to its direction but at the second scattering element 852 the red light is scattered to a broad range of angles. During the third sub-period, T3, both the first scattering element 851 and the second scattering element 852 are switched to the clear state and the green LEDs are turned on. The green light 820 passes through the first and second scattering elements 851, 852 with little change to its direction and passes out of the luminaire 820 to illuminate the surrounding environment.

The visual effect of operating the luminaire 800 in this way is that the first scattering element 851 appears to be blue as it scatters blue light, the second scattering element 852 appears red as it scatters red light while the illumination provided by the luminaire 800 is a combination of the blue and red diffuse light scattered from the scattering elements and the green light.

The scattering elements 851, 852 may have a semi-transparent appearance. Where the blue surface is seen through the red surface and the two surfaces are seen to overlap, additive mixing of the colors of the two surfaces takes place and the overlapping regions have a magenta color. This is quite different from the type of effect that can be created using colored transparent plastics, which instead provide subtractive color mixing. This allows novel visual effects to be created which cannot be achieved in conventional luminaires. The transparency of the scattering elements 851, 852 may be controlled by the magnitude of the drive voltages applied to the scattering elements 851, 852 or by the relative time for which they are in the scattering and clear states. The color and brightness of the scattering elements 851, 852 is determined by the light falling on them when they are in the scattering state.

In this example, the scattering elements 851, 852 are switched to their scattering state in different time periods. For this reason both scattering elements 851, 852 appear to be semi-transparent with respect to one another so that one scattering element can be seen through the other. If the scattering elements 851, 852 were driven so that they were both scattering during the same time period then one sheet could not be seen through the other, in other words they would not appear to be semi-transparent with respect to each other although they would still appear semi-transparent with respect to other elements or objects. This provides a further degree of control of the appearance of the luminaire 800. Alternatively, under the third embodiment, instead of using at least two LEDs, a single LED may be used where the brightness of the LED may be changed when the scattering elements 851, 852 are switched. This produces a visual effect where the scattering elements 851, 852 have different perceived levels of brightness.

Fourth Embodiment: Luminaire Displaying Switchable Patterns for Decoration or Information The third embodiment, as discussed above, disclosed the concept of a luminaire having multiple electrically switchable scattering elements controllable to have a different appearance, for example different colors, in order to control the visual appearance of the luminaire. A fourth exemplary embodiment takes this idea further, where electrodes controlling the elements are patterned to form regions of the sheet which may be individually switched between optical states, for example, scattering and clear states. A PDLC sheet may include two polymer substrates assembled to form a liquid crystal cell. The surfaces of the substrates that are inside the cell may be coated with transparent conducting electrodes. The patterning of such electrodes to form individually addressable regions of the cell is known to persons having ordinary skill in the art of video displays. Controlling the driving of these regions and the driving of illuminating LEDs in proximity of the PDLC sheet produces a surface which forms part of the luminaire which is also able to display simple patterns that may be controlled to display different predetermined patterns at different times.

Figure 11:
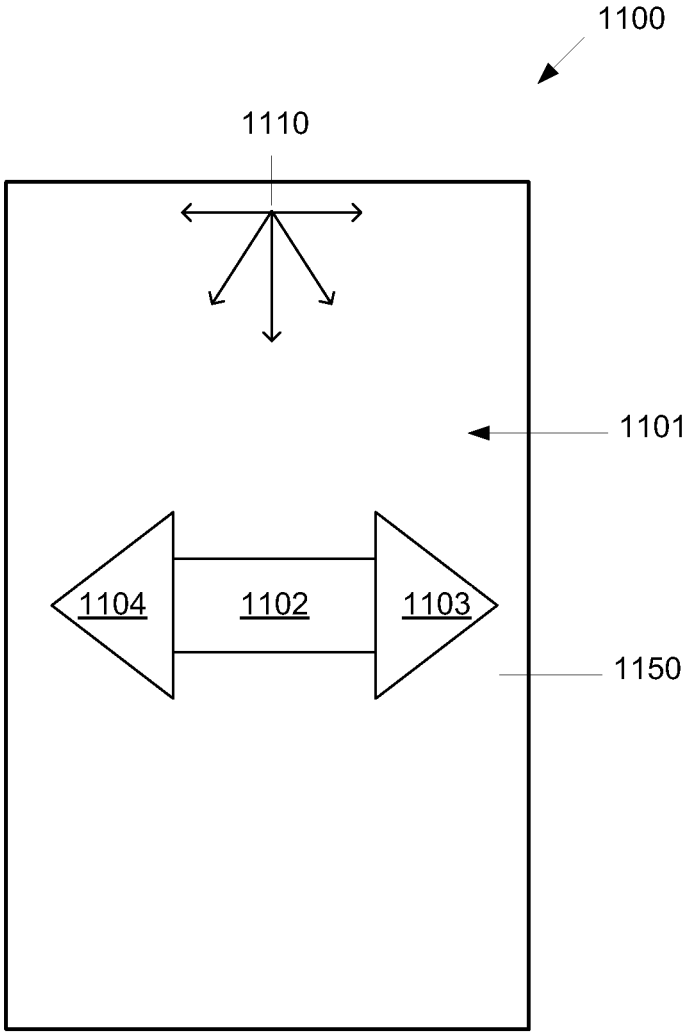
FIG. 11 is a schematic diagram of a luminaire under the fourth embodiment.

For example, a luminaire architecture as described above in connection with the second embodiment could be employed as a luminaire for lighting a corridor. An exemplary luminaire 1100 according to the fourth embodiment is shown in FIG. 11. Under the fourth embodiment, a sheet 1150 visible from the front of the luminaire may be driven to have a uniform colored appearance while illuminating the floor with white light, as described above. By patterning the electrodes of the sheet 1150 to form four separately addressable areas 1101-1104, as illustrated in FIG. 11, when required the luminaire 1100 may also be used to provide directional information in the form of an arrow. For example by arranging a first triangular shaped area 1103 and a primary area 1101 to have a first color and a second triangle shaped area 1104 and a rectangular area 1102 to have a second color, the luminaire appears to display an arrow pointing to the left. By arranging the second triangular shaped area 1104 and the primary area 1101 to have a first color and a first triangle shaped area 1103 and a rectangular area 1102 to have a second color, the luminaire appears to display an arrow pointing to the right. The colors of the different areas may be controlled by changing the drive signals to the different areas and by controlling the driving of the LEDs 1110 in a similar fashion as described in the second embodiment.

While the above example describes a relatively simple graphic having four separately addressable areas 1101-1104, there is no objection to having fewer or more addressable areas patterned to exhibit, for example, text or graphic images. Different addressable areas may be switched to a scattering state in synchronization with different colored LEDs, so that different addressable areas may appear to be different colors from one another.

Fifth Eebodiment: Projection onto Surfaces and Illumination Through Surfaces

Figure 12A:
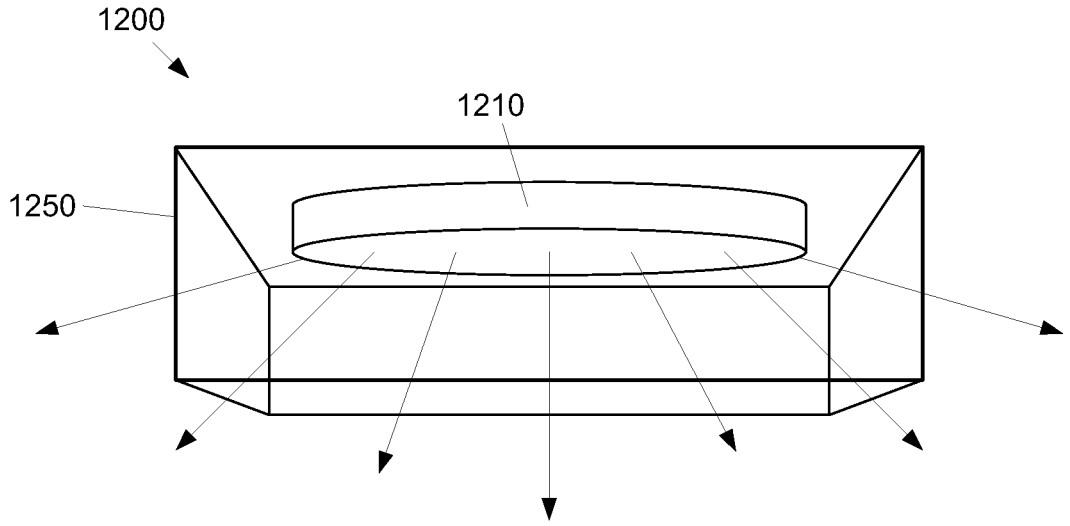
FIGS. 12A and 12B are schematic diagrams of a fifth exemplary embodiment of a luminaire.
Figure 12B:
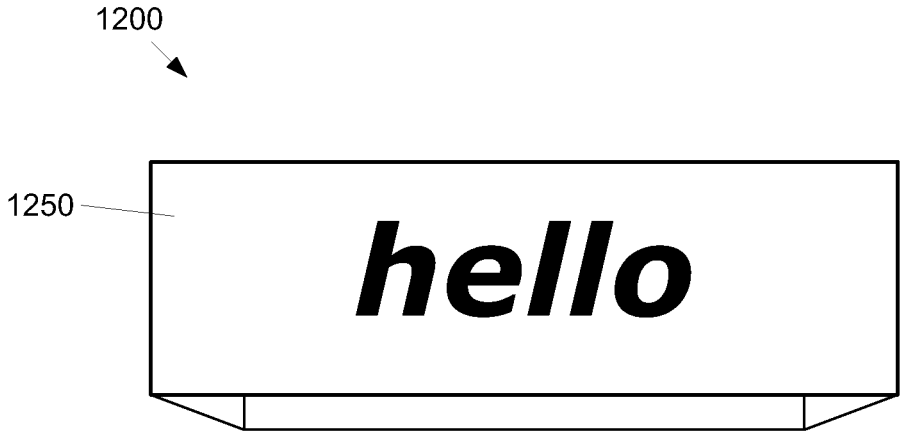

A fifth embodiment of the present invention is a luminaire that may display images or information on switchable surfaces of the luminaire by projecting text, patterns or images onto the switchable surfaces. An exemplary ceiling mounted luminaire according to the fifth embodiment is illustrated in FIGS. 12A and 12B. The luminaire 1200 includes a central light source 1210 surrounded by vertical surfaces 1250 which are electrically switchable between a diffuse state and a clear state, as described previously. The drive waveforms for the luminaire 1200 may be similar to those shown in FIG. 7, so that during the first part of each drive period, T1, the sheets 1250 are driven to the clear state and the light sources 1210 provide illumination. During the second part of each drive period the sheets 1250 are driven to the scattering state, so, for example, text, light patterns and/or images may be projected onto the sheets 1250, as shown in FIG. 12B. These patterns may result, for example, from the illumination generated by LEDs in the central light source 1210, or could be generated by a projector (not shown) whose operation is synchronized to the operation of the luminaire 1200 so that the projector only generates light during the periods T2. As the patterns or images on the sheets 1250 may have a semi-transparent appearance, it may be beneficial if objects which lie behind the sheets 1250, as seen by an observer, are dark in color or black, as this may increase the apparent contrast of the images or patterns on the sheets 1250.

Figure 13B:
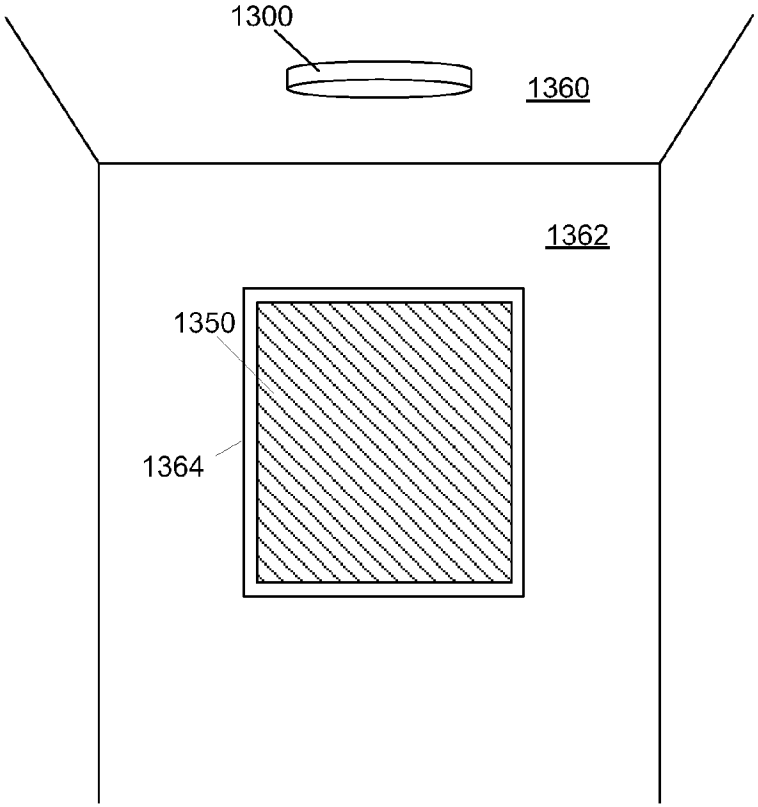
FIGS. 13A and 13B are schematic diagrams of luminaires under the sixth embodiment.
Figure 13A:
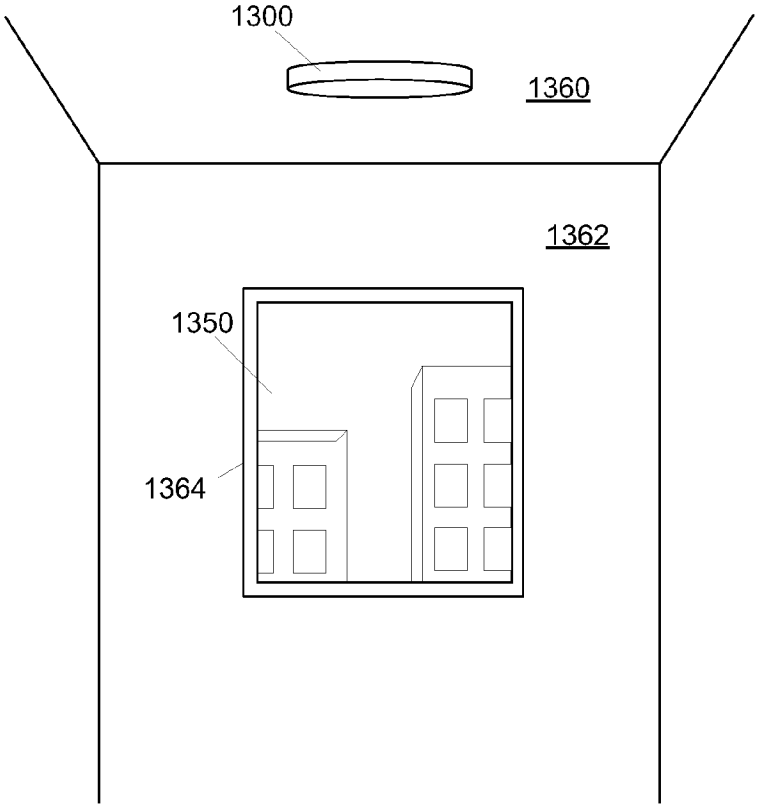

Sixth Embodiment: Controlling the Appearance of Surfaces in an Architectural Setting Under a sixth exemplary embodiment, as illustrated in FIGS. 13A and 13B, the concepts that have been described in terms of lighting modules and luminaires may be extended to a larger scale by incorporating lighting system control of switchable surfaces that are external to the lighting system. For example, a luminaire 1300 mounted on a ceiling 1360 of a room may illuminate the room, including a wall 1362 with a window 1364. The window 1364 has a switchable surface 1350 that may be controlled to change from a transparent state, as shown by FIG. 13A, to a scattering state, as shown by FIG. 13B. Furthermore, the appearance of the switchable surface 1350 may be further controlled by time sequencing the lighting elements within the luminaire 1300 and the switchable surface 1350 so the switchable surface 1350 is in a light scattering state at the same time a colored lighting element is on, as described previously, such that the switchable surface appears the color of the synchronized colored lighting element.

Coordinating control of such switchable surfaces with control of the lighting system may be used to change the appearance of switchable surfaces within a room or to change the internal and/or external appearance of switchable windows in a building. The elements of controlled light sources and controlled electrically switchable optical elements may act as separate light fittings and surfaces rather than as a single lighting module or luminaire. The means of coordinating the driving of these elements to create the required visual or illumination effects may form part of the lighting control system of the room or building. The PDLC materials referred to previously are already used in privacy glass to provide large glazed windows which can be switched between a clear state and a diffuse or opaque state. By applying the control methods described earlier to the lighting within a room with privacy glass the color and transparency of the windows could be changed giving the opportunity to change the appearance of the inside of the room or on a larger scale to change the external appearance of a building.

In various embodiments, it is desirable that the switchable surfaces and lighting elements be switched at rates fast enough that the switching is not perceived, for example, as flicker. The minimum frequency at which flicker is perceived is complex and depends on the viewing conditions, brightness, contrast, position in field of view etc. In general the minimum practical frequency is likely to be around 50 Hz although significant numbers of people may still perceive flicker at this frequency. In the best case the frequency would be 100 Hz or more but it may be limited by the speed of the switchable optical elements.

Figure 14:
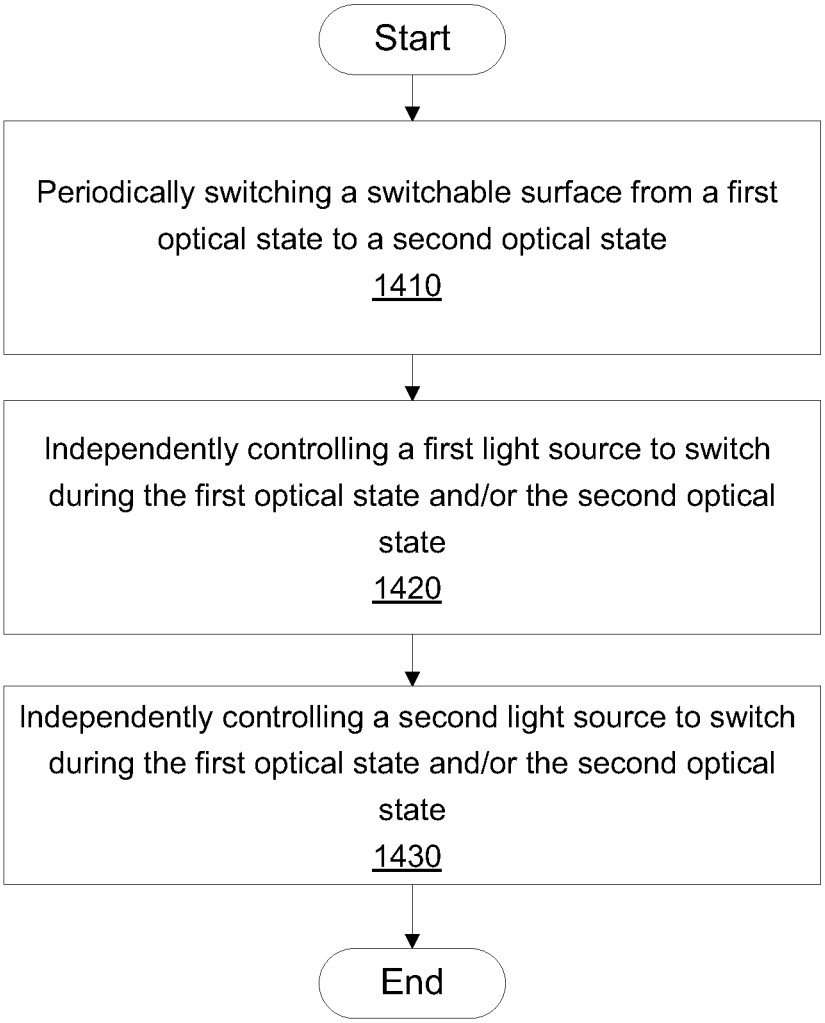
FIG. 14 is a flowchart of a method for controlling a luminaire.

An exemplary method for controlling a luminaire or lighting module according to some embodiments of the present invention is illustrated in the flowchart in FIG. 14. It should be noted that any process descriptions or blocks in flow charts should be understood as representing modules, segments, portions of code, or steps that include one or more instructions for implementing specific logical functions in the process, and alternative implementations are included within the scope of the present invention in which functions may be executed out of order from that shown or discussed, including substantially concurrently or in reverse order, depending on the functionality involved, as would be understood by those reasonably skilled in the art of the present invention.

As shown by block 1410, a step of the exemplary method includes periodically switching a switchable surface from a first optical state to a second optical state. As noted previously, the switching rate is preferably high enough so that flickering is not detected by an observer. As shown by block 1420, a first light source is independently controlled to switch during the first optical state and/or the second optical state. As shown by block 1430, a second light source is independently controlled to switch during the first optical state and/or the second optical state. For example, the first light source may be switched on and the second light source may be switched off during the sub-period when the switchable surface is in a clear optical state. Similarly, the first light source may be switched off and the second light source may be switched on during the sub-period when the switchable surface is in a scattering optical state. Of course, many other combinations of repeating sub-period states are possible, as described above. Further, more than one switchable surface may be controlled, and three or more light sources of different colors may be controlled, leading to a greater number of combinations of states during different sub-periods. Alternatively, instead of having a first light source and a second light source, a single light source may be used where the brightness of the light source may be controlled to switch to a first brightness level during the first optical state and a second brightness level during the second optical state.

Figure 15:
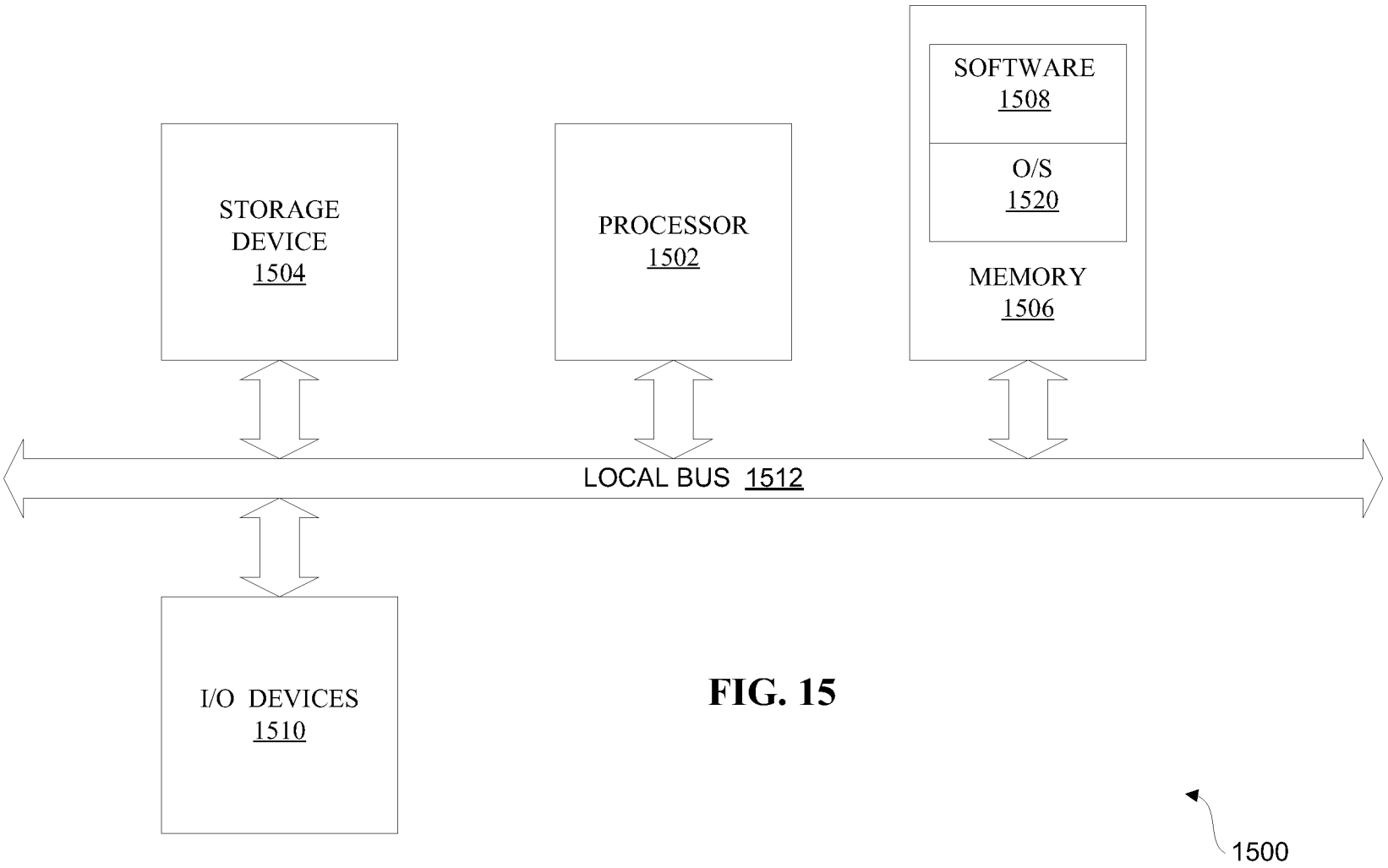
FIG. 15 is a schematic diagram illustrating an example of a system for executing functionality of the present invention.

The multiplexing controller for executing the functionality described in detail above may be a computer system, an example of which is shown in the schematic diagram of FIG. 15. The system 1500 contains a processor 1502, a storage device 1504, a memory 1506 having software 1508 stored therein that defines the abovementioned functionality, I/O devices 1510, and a local bus, or local interface 1512 allowing for communication within the system 1500. The local interface 1512 can be, for example but not limited to, one or more buses or other wired or wireless connections, as is known in the art. The local interface 1512 may have additional elements, which are omitted for simplicity, such as controllers, buffers (caches), drivers, repeaters, and receivers, to enable communications. Further, the local interface 1512 may include address, control, and/or data connections to enable appropriate communications among the aforementioned components.

The processor 1502 is a hardware device for executing software, particularly that stored in the memory 1506. The processor 1502 can be any custom-made or commercially available single core or multi-core processor, a central processing unit (CPU), an auxiliary processor among several processors associated with the present system 1500, a semiconductor based microprocessor (in the form of a microchip or chip set), a macroprocessor, or generally any device for executing software instructions.

The memory 1506 can include any one or combination of volatile memory elements (e.g., random access memory (RAM, such as DRAM, SPAM, SDRAM, etc.)) and nonvolatile memory elements (e.g., ROM, hard drive, tape, CDROM, etc.). Moreover, the memory 1506 may incorporate electronic, magnetic, optical, and/or other types of storage media. Note that the memory 1506 can have a distributed architecture, where various components are situated remotely from one another, but can be accessed by the processor 1502.

The software 1508 defines functionality performed by the system 1500, in accordance with the present invention. The software 1508 in the memory 1506 may include one or more separate programs, each of which contains an ordered listing of executable instructions for implementing logical functions of the system 1500, as described below. The memory 1506 may contain an operating system (O/S) 1520. The operating system essentially controls the execution of programs within the system 1500 and provides scheduling, input-output control, file and data management, memory management, and communication control and related services.

The I/O devices 1510 may include input devices, for example but not limited to, a control panel or pad, a remote controller, a cellular telephone, mouse, microphone, etc. Furthermore, the I/O devices 1510 may also include output devices, for example but not limited to, a switchable surface and an illumination device, etc. Finally, the I/O devices 1510 may further include devices that communicate via both inputs and outputs, for instance but not limited to, a modulator/demodulator (modem; for accessing another device, system, or network), a radio frequency (RF) or other transceiver, a telephonic interface, abridge, a router, or other device.

When the system 1500 is in operation, the processor 1502 is configured to execute the software 1508 stored within the memory 1506, to communicate data to and from the memory

1506, and to generally control operations of the system 1500 pursuant to the software 1508, as explained above.

Seventh Embodiment: Luminaire with Switchable Surfaces

Electrically switchable optical elements such as switchable mirrors or switchable scattering elements may be used for varying the output light pattern of a lighting module or luminaire. For example, a light with electrically variable scattering properties may be changed depending on the purpose for which the light is being used. A controller controls one or more electrically adjustable optical elements and one or more light sources. The electrically adjustable optical element may include, for example, a passive beam-shaping element and a controllable scattering element.

Figure 16:
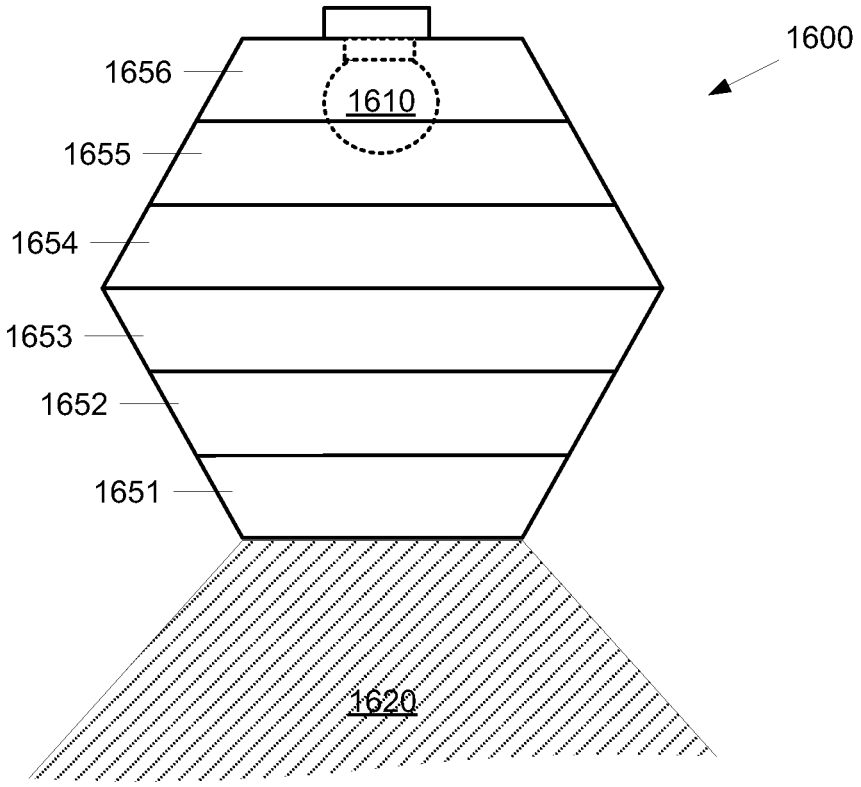
FIG. 16 is a schematic diagram of a seventh embodiment of a controlled luminaire.

An exemplary luminaire 1600 under a seventh embodiment of the present invention, shown in FIG. 16, has a light source 1610 and multiple switchable surfaces 1651-1656 which include elements which can be electrically controlled to substantially change their appearance. For example the multiple switchable surfaces 1651-1656 may have a first state in which they are substantially optically transparent and a second state in which they are optically scattering. Under the seventh embodiment, the light source 1610 and switchable surfaces 1651-1656 need not be rapidly switched. However, there is no objection to rapidly switching one or more of the surfaces 1651-1656, as described in embodiments one through six, for example, to change the color of one or more of the surfaces 1651-1656 with respect to the light source 1610.

When the luminaire 1600 is viewed those switchable surfaces 1651-1656 which are in the first state have a low visibility while those switchable surfaces 1651-1656 which are in the second states become visible and along with other components of the luminaire which are not transparent largely determine the appearance of the luminaire 1600.

By changing the state of the switchable surfaces 1651-1656, the appearance of the luminaire 1600 and the illumination effect created by the luminaire 1600 can be modified. For example the luminaire 1600 can be made to appear larger or smaller or the shape of its surface can appear to change by selectively controlling the switchable surfaces 1651-1656.

The exemplary luminaire 1600 may be formed, for example, using sheets of electrically switchable material which largely enclose the light source 1610. The switchable surfaces 1651-1656 may be, for example, a polymer dispersed liquid crystal material in which the degree of light scattering within the material can be controlled by varying the magnitude of the applied alternating voltage. When there is no voltage applied. the material is highly scattering and acts to both limit the amount of light transmitted through the material and to cause the light that is transmitted to be scattered so that it become highly diffuse in character. As the magnitude of the alternating voltage is increased, the material becomes gradually less scattering with more light being transmitted through the material. The light becomes less diffuse and more directional in character. By dividing the material into a number of independently controlled sections, 1651-1656, the luminaire 1600 may be controlled to determine the distribution of light that it creates.

FIG. 16 shows a case where all of the switchable surfaces 1651-1656 are in the scattering state. Under these conditions, a bright illumination pattern 1620 is only created directly below the luminaire 1600, since the light does not pass directly through the scattering sections 1651-1656. Further away from the luminaire 1600, a diffuse background illumination effect may be created by light which is scattered by the sections 1651-1656.

Figure 17A:
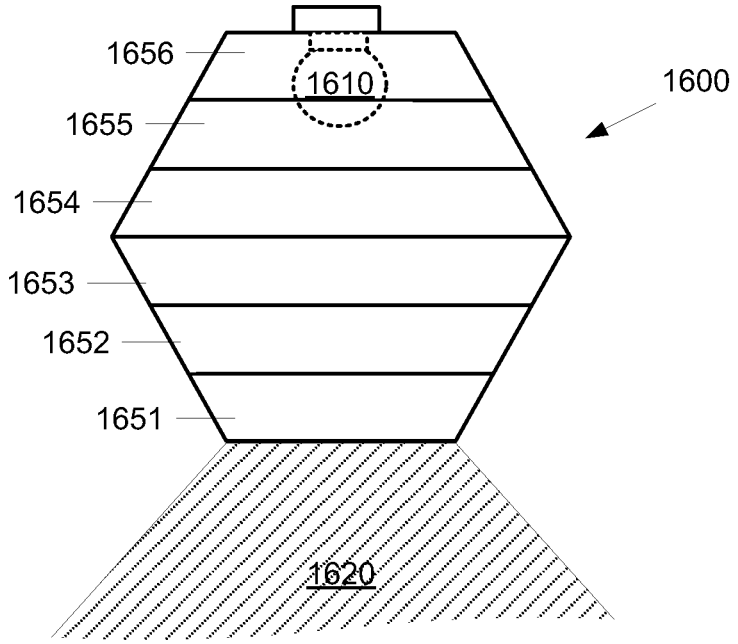
FIGS. 17A and 17B are schematic diagrams illustrating two illumination patterns of the seventh embodiment of the controlled luminaire.
Figure 17B:
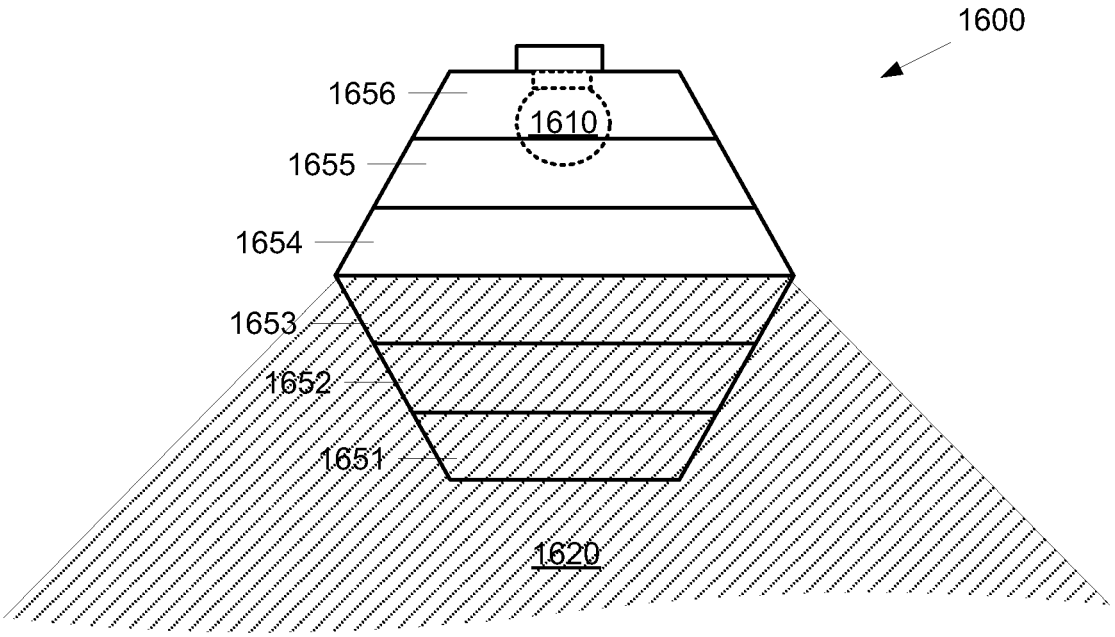

By applying an appropriate drive voltage to the switchable material sections 1651-1656, the degree of scattering of each section can be selectively controlled. When a relatively high drive voltage is applied to the sheets they become largely transparent and introduce little scattering of the light incident on them. They also become less visible to people observing the luminaire. By sequentially switching the sections 1651-1656 to the transparent state the light pattern generated by the luminaire and its appearance (size and shape) can be controlled. This is illustrated in FIGS. 17A and 17B which show how changing the transmission state of the bottom sections 1651-1653 might affect the illumination pattern 1620 created by the luminaire 1600. When the bottom sections 1651-1653 are scattering, as shown in FIG. 17A, the bright light pattern 1620 created below the luminaire 1600 has a relatively small area and the switchable material sections 1651-1656 appear to enclose the light source 1610. When bottom sections 1651-1653 are switched to the transparent state, as shown in FIG. 17B, a relatively large area 1620 below the luminaire 1600 is brightly illuminated, and the luminaire 1600 appears to be smaller and to have a more open structure.

Figure 18B:
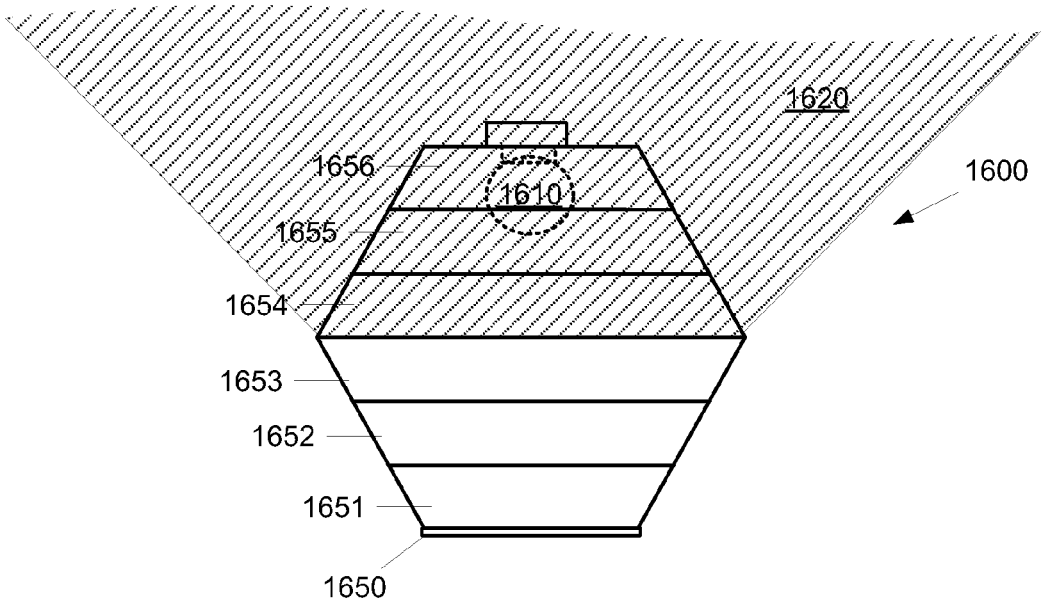

Changing the pattern in which the switchable surfaces 1651-1656 are switched to the clear state allows further control of the illumination pattern 1620. For example in FIGS. 18A and 18B, an additional section of switchable surface material 1650 has been added to cover the bottom of the luminaire 1600. In FIG. 18A the bottom sections 1650-1653 are clear and the top sections 1654-1656 are scattering, so the luminaire 1600 provides a broad down lighting effect 1620. As shown by FIG. 18B, the bottom sections 1650-1653 are scattering and the top sections 1654-1656 are clear, and the luminaire 1600 provides an up lighting effect 1620.

Additional lighting effects are possible. For example, if the bottom section 1650 is a switchable material that changes between a clear state and a reflecting state, the up lighting effect as shown by FIG. 18B may be enhanced when the bottom section is in a reflecting state.

Eight Embodiment: Luminaire with Nested Switchable Surfaces

An eighth exemplary embodiment of the present invention is a luminaire 1900 that may alter its appearance in another way, as shown by FIG. 19. Under the eighth embodiment, a first switchable surface 1901 may be arranged substantially inside a second switchable surface 1902. The first (inner) switchable surface 1901, is in the form of a cone while the second outer switchable surface 1902, is in the form of a cylinder. In FIG. 19A, the first switchable surface 1901 is set to a scattering state and the second controllable surface 1902 is set to a clear state so the luminaire 1900 has the appearance of a cone In FIG. 19B, the first switchable surface 1901 is set to a clear state and the second controllable surface 1902 is set to a scattering state so the luminaire 1900 has the appearance of a cylinder.

Switchable surfaces 1901, 1902 may be set to intermediate states in which they are semi-transparent giving further variation to the visual and illumination effects created, rather than switching the switchable surfaces 1901, 1902 directly between the scattering and clear states.

The eight embodiments described above were described separately for clarity. Of course, aspects of the eight embodiments may be combined in a number of ways to produce a variety of results.

The description has been generally restricted to the case where the electrically switchable sections switch between a scattering and a clear state. Other types of electrically switchable material can offer alternative behaviors for example where the material switches between a transparent state and a reflecting state or a transparent state and an opaque colored state.

Examples of simple lighting modules and simple luminaires have been described to illustrate the principles of the proposal. There may be many other designs possible which use the same technique to create lighting modules which allow greater control of lighting effects and luminaires which have an unexpected and controllable appearance.

A key benefit for luminaires using these techniques may be the ability to customize the appearance. For example changing the color of the scattering elements depending on the color scheme of the room in which the luminaire is used, potentially leading to increased production volumes and therefore lower cost.

The examples describe the use of electrically switchable scattering elements, such as PDLC, to make more controllable lighting modules and luminaires. Similar effects could be achieved using other electrically switchable optical elements, for example switchable mirrors.

The examples make use of color to differentiate the different lighting and visual effects that can be achieved. However, it is often the case that white light is preferred to colored light therefore it is also envisaged that lighting modules or luminaires providing white light may use this approach with the intensity of the light and the transparency of the scattering elements being the controlled variables.

Although in the examples the same LEDs illuminate the scattering elements and provide the direct illumination these two functions could be provided by different arrangements of LEDs. The number of degrees of freedom in controlling the illumination effect and the visual appearance will depend on the number of independently controllable optical elements and the number of independently controllable light sources.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein.

For example, while the embodiments above generally refer to switchable surfaces as being scattering elements, there is no objection to switchable surfaces where different optical properties are controlled, for example, variable reflection and/or variable transmission. Combining two or more types of switchable surfaces, for example, by laminating the switchable surfaces upon one another, or on different surfaces of a glass surface, and controlling the switching times of the surfaces relative to the switching times of the lighting source, may provide additional types of illumination effects.

More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

Reference numerals appearing in the claims between parentheses, if any, are provided merely for convenience, and should not be construed as limiting in any way.

The invention claimed is:

1. An apparatus for producing light discernible to a viewer, the apparatus comprising a lighting module, comprising:

a first illumination element producing a first color light, and a second illumination element producing a second color light, wherein said first color light is visually distinct from said second color light;

a switchable surface electrically switchable between a first optical state and a second optical state disposed substantially between said viewer and said lighting module; and a multiplexing controller in electrical communication with said lighting module and said switchable surface, configured to independently control a first illumination element state, a second illumination element state, and a switchable surface state, wherein said multiplexing controller is operable to switch each of said first illumination element state, said second illumination element state, and said switchable surface state at a rate of at least 10 Hz.

2. The apparatus of claim 1, wherein the multiplexing controller is configured to implement switching of said first illumination element state, said second illumination element state, and said switchable surface state such that a color of light transmitted through said switchable surface and provided by said apparatus at an area that is remote from said apparatus appears as being different from a color of said switchable surface.

3. The apparatus of claim 1, wherein said first optical state comprises a substantially transparent state and said second optical state comprises a substantially light scattering state.

4. The apparatus of claim 3, wherein said multiplexing controller is configured to switch said first illumination element to a first brightness level and said second illumination element to a second brightness level while said switchable surface is in said second optical state, and to switch said second illumination element to said first brightness level while said switchable surface is in said first optical state.

5. The apparatus of claim 3, wherein said multiplexing controller is configured to switch said first illumination element and second illumination element on for a substantially similar first duration while said switchable surface is in said first optical state, and to switch said first illumination element on for a second duration while said switchable surface is in said second optical state.

6. The apparatus of claim 3, wherein said switchable surface further comprises a first region) electrically switchable between said first optical state and said second optical state, and a second region electrically switchable between said first optical state and said second optical state, and wherein said first region and said second region are independently controlled by said multiplexing controller.

7. The apparatus of claim 1, wherein said first illumination element comprises a first LED and said second illumination element comprises a second LED.

8. An apparatus for producing light discernible to a viewer comprising a lighting module, comprising:

a first illumination element producing a first color light;

a second illumination element producing a second color light; and a third illumination element producing a third color light, wherein said first color light, said second color light, and said third color light are visually distinct from one another;

a second switchable surface electrically switchable between a first optical state and a second optical state disposed substantially between said viewer and said lighting module; and a first switchable surface electrically switchable between a corresponding first optical state and a corresponding second optical state disposed substantially between said second switchable surface and said lighting module; and a multiplexing controller in electrical communication with said lighting module, said first switchable surface, and said second switchable surface, configured to independently control a first illumination element state, a second illumination element state, a third illumination element state, a first switchable surface state, and a second switchable surface state, wherein said multiplexing controller is configured to independently switch each of said first illumination element state, said second illumination element state, said third illumination element state, said first switchable surface state, and said second switchable surface state at a rate of at least 10 Hz.

9. The apparatus of claim 8, wherein:

said first optical states of said first switchable surface and said second switchable surface comprise a substantially transparent state; and said second optical states of said first switchable surface and said second switchable surface comprise a substantially light scattering state.

10. The apparatus of claim 9, wherein said multiplexing controller is configured to switch said first switchable surface to scatter said first color light, and to switch said second switchable surface to scatter said second color light.

11. The apparatus of claim 10, wherein said first switchable surface substantially encloses said lighting module, and said second switchable surface substantially encloses said first switchable surface.

12. The apparatus of claim 8, wherein:

said first illumination element comprises a first LED;

said second illumination element comprises a second LED; and said third illumination element comprises a third LED.

13. The apparatus of claim 8, wherein the multiplexing controller is configured to implement switching of said first illumination element state, said second illumination element state, said third illumination element state, said first switchable surface state, and said second switchable surface state such that a color of light transmitted through said second switchable surface and provided by said apparatus at an area that is remote from said apparatus appears as being different from a color of said second switchable surface.

14. The apparatus of claim 13, wherein the multiplexing controller is configured to implement switching of said first illumination element state, said second illumination element state, said third illumination element state, said first switchable surface state, and said second switchable surface state such that a color of said first switchable surface appears as being different from the color of light provided by said apparatus at the area and from the color of said second switchable surface.

15. A system for illuminating an interior space comprising:

a lighting module comprising:

a first illumination element producing a first color light; and a second illumination element producing a second color light, wherein said first color light is visually distinct from said second color light;

a switchable surface electrically switchable between a first optical state and a second optical state disposed substantially apart from and said lighting module, wherein said switchable surface is substantially illuminated by said lighting module; and a multiplexing controller in electrical communication with said lighting module and said switchable surface, configured to independently control a first illumination element state, a second illumination element state, and a switchable surface state, wherein said multiplexing controller is operable to switch each of said first illumination element state, said second illumination element state, and said switchable surface state at a rate of at least 10 Hz.

16. The system of claim 15, wherein:

said first optical state comprises a substantially transparent state; and said second optical state comprises a substantially light scattering state.

17. The system of claim 16, wherein said switchable surface comprises a window of a building.

18. The system of claim 15, wherein wherein the multiplexing controller is configured to implement switching of said first illumination element state, said second illumination element state, and said switchable surface state such that a color of light transmitted through said switchable surface and provided by said apparatus at an area that is remote from said apparatus appears as being different from a color of said switchable surface.

* * * * *